US006581299B1

(12) United States Patent
Dedieu et al.

(10) Patent No.: US 6,581,299 B1
(45) Date of Patent: Jun. 24, 2003

(54) METHOD FOR EXTRACTING NATURAL JUICE OF LIGNEOUS PLANT MATERIAL, DEVICE FOR CARRYING OUT SAID METHOD AND USE OF SAID METHOD IN THE PRODUCTION OF DRIED LIGNEOUS PLANTS MATERIAL

(75) Inventors: Bernard Dedieu, Olivet (FR); Abdelaaziz Bouirdène, Balma (FR)

(73) Assignee: Valeurs Bois Industrie, Saran (FR)

( * ) Notice: Subject to any disclaimer, the term of this patent is extended or adjusted under 35 U.S.C. 154(b) by 0 days.

(21) Appl. No.: 09/959,570

(22) PCT Filed: Apr. 28, 2000

(86) PCT No.: PCT/FR00/01141

§ 371 (c)(1),
(2), (4) Date: Oct. 30, 2001

(87) PCT Pub. No.: WO00/66960

PCT Pub. Date: Nov. 9, 2000

(30) Foreign Application Priority Data

Apr. 30, 1999 (FR) ..... 99 05555

(51) Int. Cl.[7] ..... F26B 3/34

(52) U.S. Cl. ..... 34/259; 530/202; 530/203; 530/500; 528/1; 528/503; 210/761; 210/767; 210/748; 210/513; 422/186; 422/261; 422/287; 422/292; 422/298; 34/245; 34/528; 34/165

(58) Field of Search ..... 530/202, 203, 530/500; 528/1, 503; 210/767, 748, 761, 513; 422/186, 261, 787, 292, 298; 34/245, 259, 528, 165

(56) References Cited

U.S. PATENT DOCUMENTS

| | | | | |
|---|---|---|---|---|
| 3,721,013 A | * | 3/1973 | Miller | 34/265 |
| 3,845,270 A | * | 10/1974 | Widugris, Jr. | 219/757 |
| 4,343,095 A | * | 8/1982 | Rosen et al. | 34/411 |
| 4,416,069 A | * | 11/1983 | Rosen et al. | 34/380 |
| 4,447,402 A | * | 5/1984 | Cox | 422/174 |
| 4,485,564 A | * | 12/1984 | Iverlund et al. | 34/265 |
| 5,528,209 A | * | 6/1996 | Macdonald et al. | 333/247 |

FOREIGN PATENT DOCUMENTS

| | | | |
|---|---|---|---|
| EP | 0505586 | * | 9/1992 |
| GB | 2306090 | * | 4/1997 |
| WO | 82/01411 | * | 4/1982 |
| WO | 93/02842 | * | 2/1993 |
| WO | 99/23429 | * | 5/1999 |

* cited by examiner

*Primary Examiner*—Samuel A. Acquah
(74) *Attorney, Agent, or Firm*—Nixon & Vanderhye

(57) ABSTRACT

The invention relates to a method for extracting the natural juice of ligneous plant material, a device for carrying out said method and the use of said method in the production of dried ligneous plant material. The method for extracting the natural juice of ligneous plant material comprises the following: a pressurization step in which a sealed enclosure containing the plant material is pressurized, whereby the pressure thereof is greater than that of the atmosphere; a stage in which saturating water vapor is created or injected; a stage in which the plant material is heated to the core by means of electromagnetic waves; a step in which the liquid exudates from said plant material are gravitationally recovered.

22 Claims, 4 Drawing Sheets

METHOD FOR EXTRACTING NATURAL JUICE OF LIGNEOUS PLANT MATERIAL, DEVICE FOR CARRYING OUT SAID METHOD AND USE OF SAID METHOD IN THE PRODUCTION OF DRIED LIGNEOUS PLANTS MATERIAL

The present invention concerns a process for extracting natural liquor from ligneous plant matter, a device allowing implementation of the process and use of the process for the production of dried ligneous plants, or liquor.

By the term "saw wood" is understood wood stemming directly from initial processing (sawing).

There is known from patent application WO 82/01766 a process for drying wood, using microwaves at a frequency of 915 MHz applied to the elements of wood to be dried in order to raise their internal temperature and to make them reject water. Water rejected in this way is evaporated on the surface of the wood by low speed air circulation obtained by fans. The air with about 80% humidity passes over condensers in order to extract this humidity.

In the document WO 82/01411, the same principle is used but in the latter, it is additionally noted that the air temperature must always be lower than the internal temperature of the wood. This document cites as a drawback the fact that the surface area of the material is heated with microwaves before the internal part of the material is heated. In this document, it is therefore proposed to control the process of converting electromagnetic energy into heat energy in order to concentrate the waves on the water in the material. Moreover, it is suggested to act on the climate within the chamber by maintaining a high enough percentage of air humidity for the surface of the product not to dry out before the humidity at the wood core is extracted. To this end, during the initial phase of the drying process, water in an atomised form is introduced into the chamber to maintain a high moisture content.

Likewise, the article which appeared in the review "Holz als roh und werkstoff" in 1995, pp 333 to 338, published by Springer-Verlag and entitled "Microwave drying of pine and spruce" by A. L. ANTTI gives instructions on drying wood with microwaves operating at frequencies of 915 or 2450 MHz and a power density located in the range of 25 to 78 $kW/m^3$ to reach the internal temperature of the wood at about 140° C. and to achieve a vapour pressure internal to the wood of 25 KPa. The internal pressure realised in this way is very high to allow very rapid drain-off of water. The drawback of the process is that fractures develop in the fibres. The drying process begins by rapid microwave drying at about 70° C. then an intermittent exposure to microwaves during the drying and lastly, a drying operation by controlling the temperature of the wood beneath fibre saturation keeping within a maximum temperature of 110° C.

In every hypothetical case, it is clear that air is used as the vehicle to remove the humidity discharged by the wood. For these reasons, the air moisture content must remain below the air saturation value in water vapour. It is therefore necessary in known devices for the air to be dehumidified in order to be able to dry out the wood. Moreover, it is necessary to have an air temperature below that of the wood in order to allow evaporation. The drawback of all these devices is that big energy losses are generated and energy consumption is not optimised. Indeed the higher the wood temperatures are to be, the more the power of the microwave generators must be proportionate and the higher their cost given drying operations lasting several hours, the greater the energy consumed. Indeed, it may be seen in the article cited above that drying times are between 3 and 5 hours according to the thickness of the wood and the power of the equipment. Moreover, none of the known processes manages to get below 30% humidity in the wood after drying.

Lastly it is also known from French patent applications 2 763 795 and 2 705 035 for a natural product to be extracted by microwaves from a biological material by making the biological material undergo, in the absence of any solvent, microwave irradiation in order to cause at least a part of the water contained in the material to evaporate and the cellular structures to burst. The process consists in applying reduced pressure intermittently within the enclosure in order to facilitate this bursting. The use of microwaves serves essentially to compensate for the drop in temperature resulting from the water evaporation. Whatever the circumstances, the temperatures used remain below 100° C. and the pressures below atmospheric pressure (1 bar). According to this process, pressures of about 100 millibars and temperatures of about 70° C. are used.

The purpose of the present invention is to propose a process, which allows energy to be optimised and a maximum yield in liquor production, per quantity of processed fibrous plant matter, to be obtained.

This purpose is fulfilled by the fact that the process for extracting natural liquor from ligneous plant matter comprises:

- a stage of pressurisation above atmospheric pressure of a sealed enclosure containing the matter;
- a stage of creation or injection of saturated water vapour;
- a stage of heating to the core of the plant matter by electromagnetic waves;
- a stage of gravitory recovery of the liquid exudations emerging from the processed plant matter.

According to another particularity, the recovery stage may be executed at least in part during the stage of creation or injection of saturated water vapour.

According to another particularity, the total pressure is between 1.5 and 9.6 bars.

According to another particularity, the total pressure is adapted as a function of the plant matter processed and of the vapour temperature surrounding this matter.

According to another particularity, the wave power is modulated to allow the matter to be heated to the core, which is from a few tenths of a degree to a few degrees above the vapour temperature resulting from the total pressure selected.

According to another particularity the volume of water at atmospheric pressure and external ambient temperature is equivalent to two to four times the volume of air contained in the enclosure in the same conditions.

According to another particularity, the volume necessary for the saturated vapour pressure, for the operational temperature selected is about three times the air mass contained in the enclosure at ambient temperature.

According to another particularity, the wave frequency is adapted to the size of the mass of plant matter to be processed in the enclosure, so as to allow the waves to penetrate right to the core of the plant mass to be processed.

According to another particularity, the wave frequency is between 13 MHz and 2450 MHz.

According to another particularity, the process comprises a stage of draining off the liquors out of the enclosure under pressure during or in the course of the extraction process.

According to another particularity, the process comprises a stage of adaptation, after the liquors have been drained off, of the conditions of total pressure, temperature and wave control power to facilitate the penetration into the wood of additive products injected into the enclosure.

Another purpose of the invention is to propose a device allowing the process to be implemented.

This purpose is fulfilled by the fact that the device is constituted by a sealed enclosure resistant to pressure, by a plurality of windows made of quartz or of any other material suiting waves with an electromagnetic wave generator placed near each window, so as to emit the waves transversely to the mass of plant material placed in the enclosure, a device for generating saturated water vapour at pressure above atmospheric pressure so as to create or inject a saturated water vapour pressure at a vapour temperature and at a total pressure determined as a function of the plant to be processed.

According to another particularity, the device comprises pressurised air circulation means.

According to another particularity, the vapour generator device allows vapour to be injected under pressure at the pre-set vapour temperature and total pressure.

According to another particularity, the vapour generator device comprises in the enclosure a receptacle for receiving a quantity of water corresponding to two to four times the air mass contained in the enclosure at external ambient temperature and means of heating this water to bring it to the vapour state.

According to another particularity, the heating means are controlled by a device, which measures the total pressure prevailing within the enclosure allowing the water heating to be interrupted when the desired pressure is reached.

According to another particularity, the enclosure comprises a device for recovering liquors by run-off and/or gravity of the liquor extracted from the matter.

According to another particularity, the liquor recovery device communicates via a sluice with the outside of the enclosure, said sluice being controlled in order to carry out partial draining of liquor while the machine is operating.

According to another particularity, the mass of plant matter processed in a liquor extraction operation is constituted by plant type and the pressure and temperature conditions are determined as a function of the plant oil type in order to extract the worthwhile active constituents in the best conditions.

According to another particularity, the woods are processed with bark or without bark straight from felling.

According to another particularity, the plants are the branches and leaves resulting from pruning.

A final purpose is to obtain a natural liquor.

This purpose is fulfilled by the fact that the natural liquor is obtained from processing ligneous plant matter.

Other particularities and advantages of the present invention will emerge more clearly from reading the following description given with reference to the appended drawings in which:

BRIEF DESCRIPTION OF DRAWINGS

As shown in FIG. 1A, the device is constituted by a preferably cylindrical enclosure (1) made of a metal material providing, on the one hand, both good thermal insulation and pressure tightness and, on the other hand, wave tightness. This enclosure is open at one end by one door (16, FIG. 1B) or two. Apertures (14) are provided in the enclosure to constitute windows made of an airtight material but letting through radiation from the electromagnetic waves such as for example microwaves. These pressurised windows (14) are made of a material which allows the pressures created in the enclosure to be withstood and the waves to be emitted towards the inside of the enclosure and said emitting windows. These windows (14) are of a size and placed at locations allowing the electromagnetic waves to be sent to the totality of the plant mass introduced into the enclosure and right to its core. The waves are brought by a guide wave (14) to a plurality of windows arranged longitudinally and on each side at intervals whether regular or not along the wood stack (3) to obtain the most homogeneous wave distribution possible. The guide wave (40) communicates through an impedance corrector (41) and a 3-decibel divider (42) with an insulator (43) and the electromagnetic wave generator (44) with a frequency in a frequency range extending between 1 MHz and 16 GHz. Between each emitting window (14) or between the emitting windows of the ends and each enclosure bottom are preferably arranged a plurality of channels (12) circulating air forced by a ventilator V. These channels (12) communicate at a height corresponding approximately to that of the wood stack through grids (13) with the internal zone of the enclosure containing the wood stack (3) transported on a transporting means such as, for example, a truck constituted of wheels (32) mounted on a support plate (31). The stack of wood or ligneous plants is preferably constituted by pieces (30) in the form of branches, planks or boards or beams of unspecified thickness and width, stemming from pruning or sawing and arranged in respect of the planks, boards or beams contiguously over their length or in respect of the branches in a bundle along a longitudinal direction to form a layer. Each layer of wood or plants is spaced out from the lower layer by battens or rods (33) placed perpendicularly in a non-contiguous way so as to provide between the contiguous layers or plant bundles passages for the circulation of air, waves and water. The air circulation circuit is also made of a material facilitating the reflection of waves towards the inside of the enclosure and the wood. The enclosure is connected via a channel (15) with a vapour generator system (2) and possibly, an air compressor (20). The humidity arrives from the vapour generator via scatter grids (13), which allows it to be scattered homogeneously in the enclosure without the danger of causing frontal attacks on the wood. The air compressor (20) is used to produce compressed air intended to accelerate water circulation in the wood and when the vapour generator system (2) cannot generate vapour at sufficient pressure to rise to the desired temperature or to accompany the rise in temperature and accelerate water circulation in the wood. On the other hand, when a vapour generator system is used at sufficient pressure to reach the desired temperatures and pressures, the air compressor may be eliminated. The enclosure comprises means of loading and unloading the masses of plants to be processed and means of recovery of liquors or liquid exudations extracted from the plants. In the example shown, the wheels of the truck run on rails (10A, 10B) integral with the bottom of the tank (1) they are provided with an electric arc elimination device. A grid (19) makes it possible to prevent wave propagation towards the liquid exudations or run-off waters collected in the tank bottom. These run-off waters are drained off through a channel (18) controlled by a sluice (17). This channel (18) emerges in a removable or drainable recovery container for the liquid exudations resulting from the drying process. In a variant, the channel is open permanently or intermittently. Lastly, the upper part of the tank comprises a safety valve (11), which allows the tank to be maintained at the desired pressure, the pressure to be drained off if it is too high and lastly the tank to be put to the atmosphere once the drying process is complete.

Figure 1A:
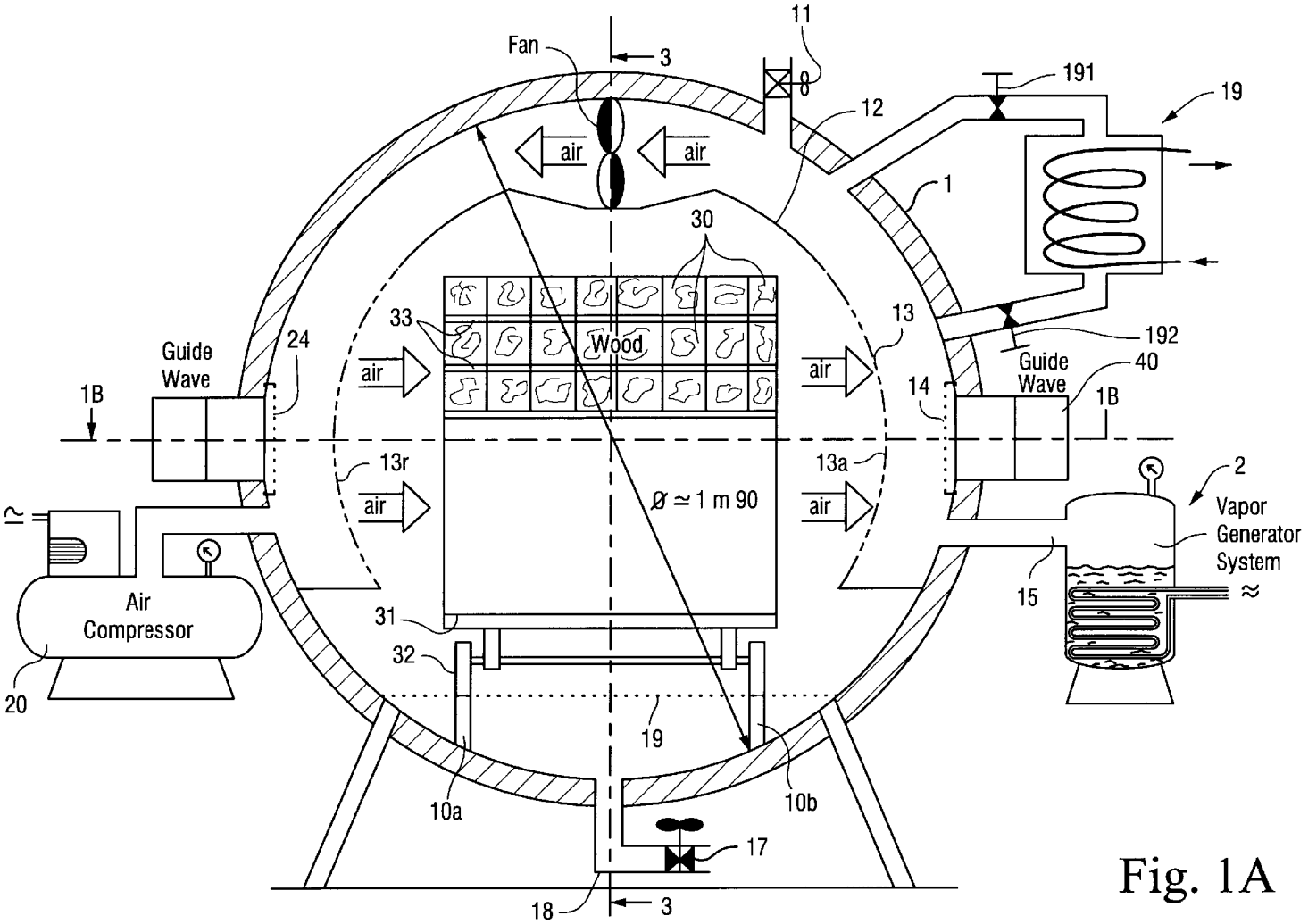
FIG. 1A shows a transverse cross-section of the device according to the invention.
Figure 1B:
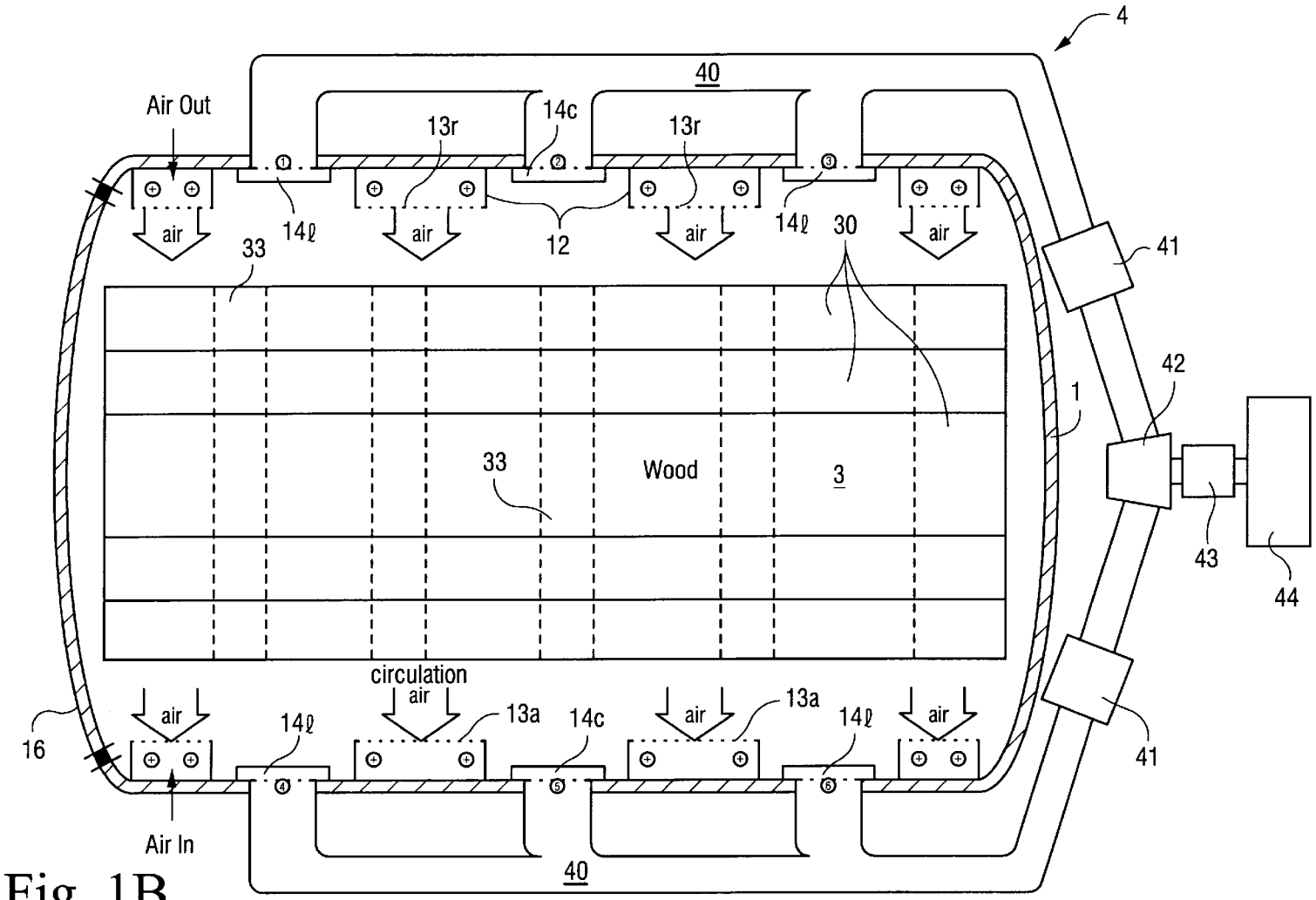
FIG. 1B shows a view from above in a longitudinal cross-section of the device according to the invention.
Figure 2:
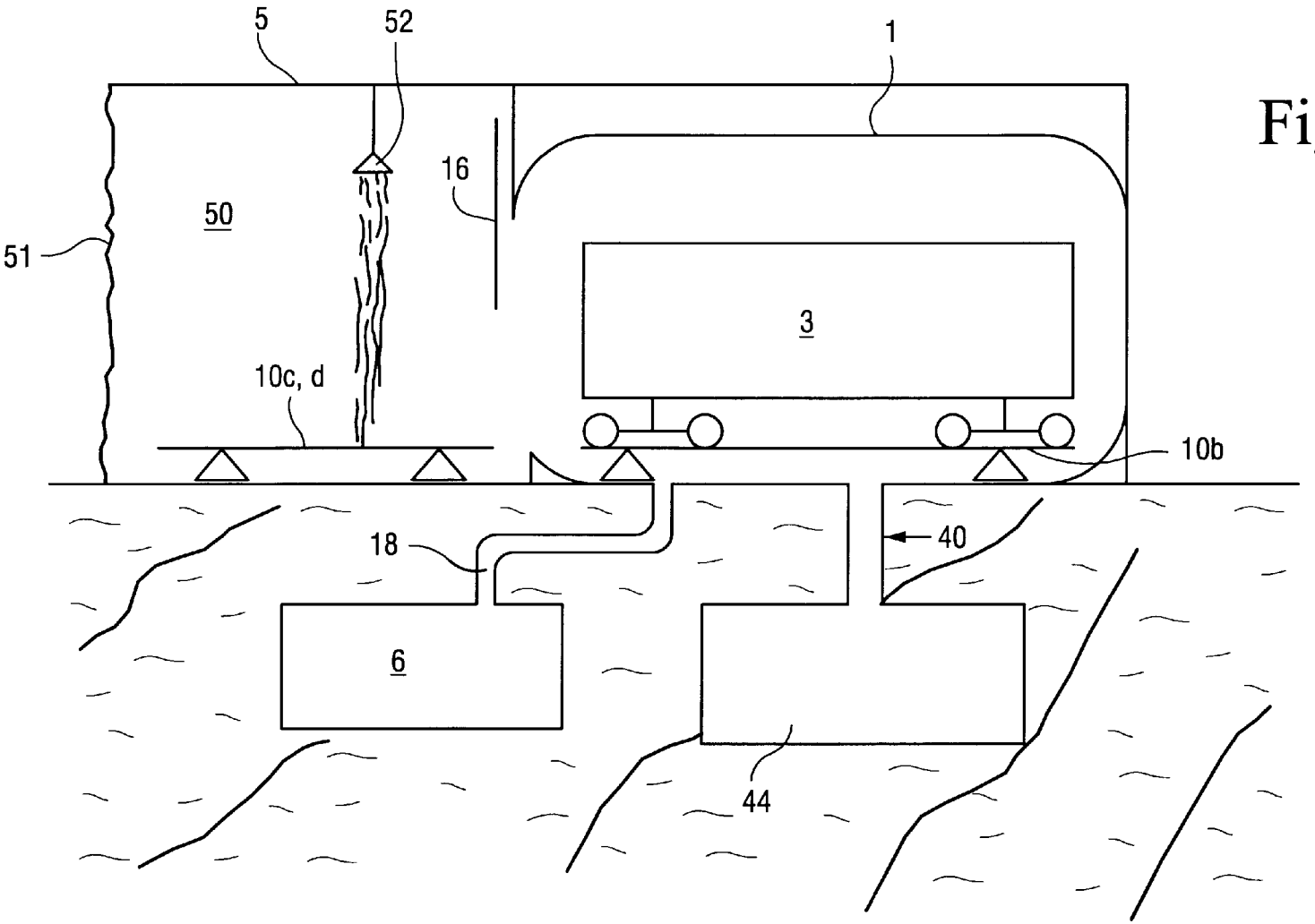
FIG. 2 shows a view from the side of the installed device.

In the installation diagram in FIG. 2, the tank (1) is enclosed within an enclosure (5), which communicates via the door-lock (16) controlled automatically at the end and at the outset by an electronic control system. A pre-loading zone (50) allows the trucks to be brought on a pair of rails (10C, 10D), which are not in electrical relation with the rails (10A, 10B) of the enclosure (1). A vaporisation device (52) allows water to be projected during the wave use phase to prevent any outward radiation leak. A removable and drainable reserve tank, not shown, is connected to the enclosure (1) by a channel (18) and allows the liquid exudations coming from the drying wood to be collected. To reduce leaks the electromagnetic wave generator (44) is interred like the reserve tank (6) and communicates with the drying enclosure (1) via the guide wave (40).

Figure 3:
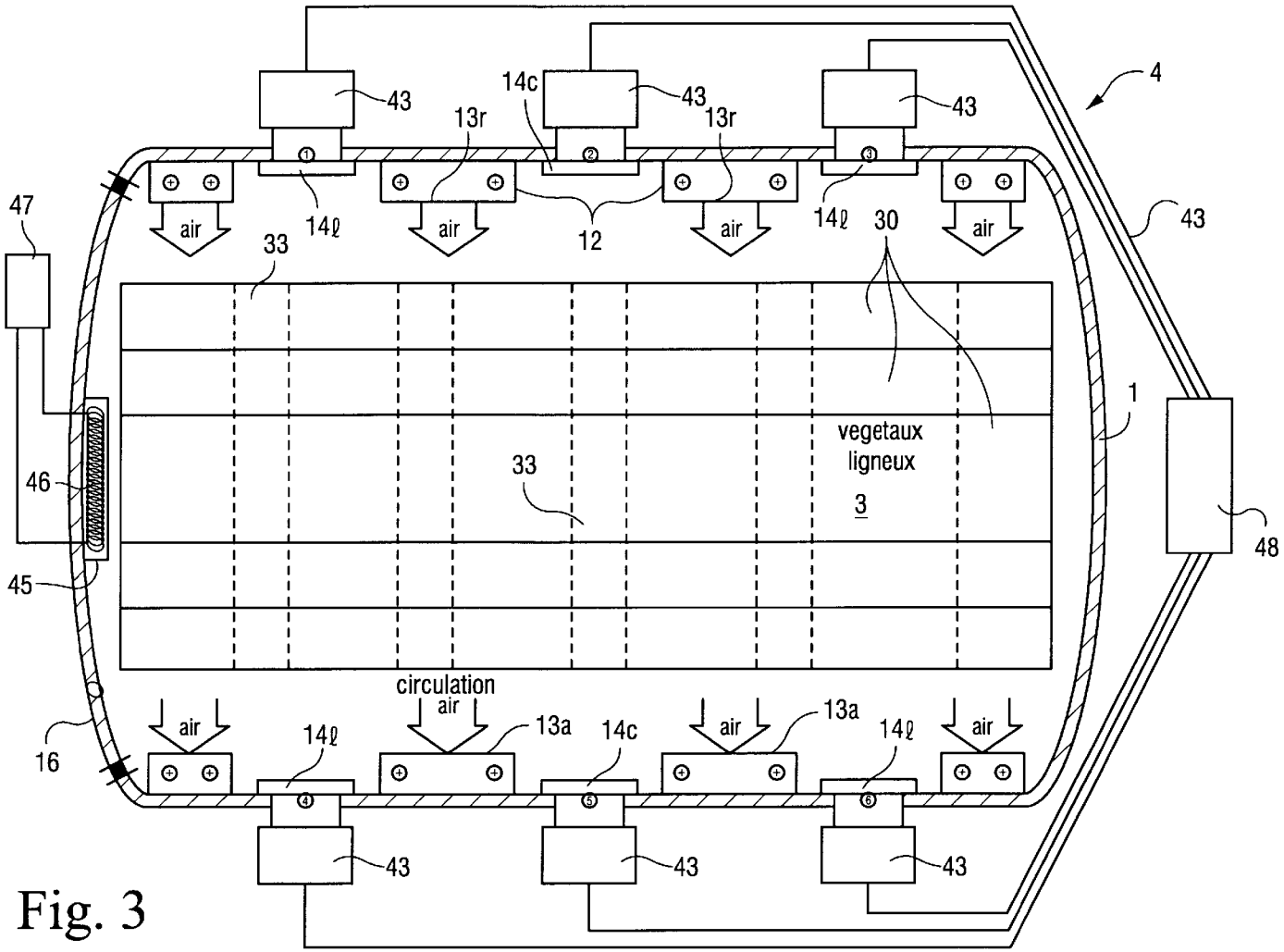
FIG. 3 shows a view from above in longitudinal cross-section of the device according to a second variant of the invention.

FIG. 3 shows a second embodiment variant of the enclosure in which on either side of the enclosure are placed three windows (141), each of the windows being located opposite a microwave generator (43) having a power, for example, of about 1000 watts, this power being controlled through a respective link (431), by a control system (48) which allows the power to be adapted, for each wave, as a function of the heating which it is desired to create via the waves within the plant. The enclosure also comprises a receptacle (45) of sufficient size to contain a water mass corresponding to about four times the air mass contained in the enclosure when it is at atmospheric pressure and ambient temperature of the external air. A heating resistor (46) placed in the receptacle (45) allows the temperature of the water mass to be increased and for it to be brought progressively to the vapour state while raising the pressure within the enclosure. This resistor (46) is connected to a control circuit (47) whether or not integrated with the control system (48) which controls the power supply to the resistor as a function of the saturated vapour temperature required to process the materials and of a pressure signal provided by a pressure detector, not shown, allowing a signal to be provided to the control circuit (47) representing a correlation between the total pressure prevailing within the enclosure and the saturated vapour temperature created in this enclosure by the heated water.

The quantity of water required to reach the saturated vapour state depends quite obviously on the temperature at which it is desired to process the plant mass but it may be considered that in the saturated vapour temperature range which varies from 90 to 170° C., the mass required relative to the dry air mass contained in the enclosure at the outset, is about two to four times the air mass. Quite obviously, if too much water is put in, it will remain at the bottom of the receptacle and will not be transformed into the vapour state, unless the temperature and consequently the pressure is further increased. It should be remembered that, in saturated vapour conditions, the temperature of 90° C. corresponds to a total pressure prevailing within the enclosure of 1.5 bars. By "total pressure" is understood the air pressure plus the saturated vapour pressure. The saturated vapour temperature of 100° C. corresponds to a total pressure of 2 bars and 170° C. to a total pressure of 9.6 bars.

Through experiment it has been observed that the desirable conditions for extracting liquors were a total pressure above atmospheric pressure, and an ambient temperature in the enclosure about 100° C. So long as the ambient temperature is below 100° C., the liquors comprise very few molecules of interest for the chemical industry. Once the ambient temperature of 100° C. has been reached, the temperature of the ligneous material stack increases and liquors can be recovered if 170° C. and, consequently, the 9.6 bars of pressure are exceeded, the molecules are either altered, or have been destroyed.

Lastly, for energy saving reasons, it is desirable, to optimise the process, to use sufficient microwave power to produce within the plant mass a temperature slightly above the temperature prevailing in the enclosure. The purpose of this temperature is to facilitate the extraction of the liquors from the ligneous plant matter. Quite obviously, temperatures and pressures are selected in these ranges as a function of the oils and plant matter processed or as a function of the molecules it is desired to extract. It has also been noted that the higher the pressure, the more the movement of the liquors was facilitated but that a compromise had to be established between the extraction of liquors and the preservation of the molecules or the qualities and properties of the desired molecules.

Thus, by this process, it is possible to extract from woods different natural molecules to use them in different business sectors, such as pharmaceuticals, cosmetics, the food industry, fine chemistry, etc. These liquors enable by subsequent processing the extraction of phenol, polyphenol, tannin, terpene, vitamins, acetic acid, salicylic acid, flavourings, etc.

2 bars of pressure may be used for a saturated vapour temperature of 100° C., 2.7 bars for a temperature of 130° C,. 3 bars for a temperature of 140° C., 3.5 bars for a temperature of 150° C., up to 9.6 bars for a temperature of 170° C. The rises in temperature and pressure may occur in successive stages or gradually or again according to cycles allowing the desired result to be optimised, namely the production of liquors or drying of ligneous matter. The electromagnetic wave power will also be controlled in such a way that a slight temperature and therefore pressure gradient materialises from the center of the stack outwards, the generators located near the end zones of the stack emitting a slightly lower power. The electromagnetic wave frequency is adapted to the size of the mass of plant matter to be processed in the enclosure, so as to allow the waves to penetrate right to the core of the plant mass to be processed and may be selected in the frequency range from 1 MHz to 16 GHz. The wave frequency may be selected in the microwave range between 400 MHz and 2450 MHz or for applications requiring a greater wave penetration. It is possible to use frequencies of the order of 13 or 17 MHz or even between 17 and 400 MHz. The oils will be selected as a function of the desired results. For example, when processing beech, pedunculate oak or sessile oak a high calcious leaf area index is obtained which is the sign of the presence of molecules of interest to the chemical industry. The pH constituted by the formic and acetic acids is also higher than for the liquors obtained by traditional extraction processes. Also notable is a strong presence of tannins, wyskilin, guaiacol, phenol and polyphenols. Phenols are the base products for thermosetting polymers and thermoplastic polymers. Polyphenols allow the production of free anti-radicals (anti-ageing products). By processing coniferous trees, terpene or again insecticides may be extracted. Through the processing of willow and poplar, salicylic acid may be extracted. Processing Scots pine allows insecticides to be produced. Likewise, from poplar, salicylic acid may be extracted. By processing yew wood, desacetylbaccatine 3 also known by the name "Taxol" is extracted. For example, the Corsican pine produces terpenes and/or volatile terpenic alcohols such as isoborneol serving as a base product for essential oils (perfume) or methylvanillin (natural vanilla extract), non-volatile resinic acids, such as isomers or dehydroabietic acid.

This process may also be applied to any other oil, such as eucalyptus, spruce or predetermined oil blends or again to the processing of branches and leaves following pruning.

Quite obviously, other plant matter may be processed in accordance with this process without departing in any way from the invention.

The process also makes it possible, in addition to liquor production, to obtain dried plant matter for other applications, such as the manufacture of posts, dry wood fencing or the use of the other parts of dried plants as additives in for example the manufacture of insulating materials.

Other modifications within reach of the man skilled in the art are also part of the spirit of the invention. Thus, any transport device may be used instead of the rail-mounted truck. Likewise, control and regulation devices will be able to trigger the successive phases of the process in association with more or less sophisticated automation. Likewise, the enclosure comprises a safety valve (11) allowing the enclosure to be opened into the open air, either at the end of the process, or in the event of excess pressure being detected by the control system.

Moreover, at the end of the liquor extraction process after having collected and emptied the enclosure of the majority of the liquor without causing the pressure to drop significantly, it is possible to inject additional products for the processing of plants, such as for example in the case of wood, anti-fungal agents or polymerising materials. In the case of polymerising materials, the temperature and pressure may be increased during this phase to the maximum or even exceed 170° C. and rise to 200° C. under a total pressure and a core temperature created by the microwaves at the core of the material regulated to facilitate penetration of the polymerising materials.

What is claimed is:

1. A process for extracting natural liquor from ligneous plant matter characterised in that it comprises:

a stage of pressurisation above atmospheric pressure of a sealed enclosure containing the matter;

a stage of creation or injection of saturated water vapour;

a stage of heating to the core of the plant matter by electromagnetic waves;

a stage of gravitory recovery of the liquid exudations emerging from the processed plant matter.

2. A process for extracting natural liquor from ligneous plant matter according to claim 1, characterised in that the recovery stage may be executed at least in part during the stage of creation or injection of saturated water vapour.

3. A process for extracting natural liquor from ligneous plant matter according to claim 1, characterised in that the total pressure is between 1.5 and 9.6 bars.

4. A process for extracting natural liquor from ligneous plant matter according to claim 1, characterised in that the total pressure is adapted as a function of the plant matter processed and of the vapour temperature surrounding this matter.

5. A process for extracting natural liquor from ligneous plant matter according to claim 1, characterised in that the electromagnetic wave power is modulated to allow the matter to be heated to the core, which is from a few tenths of a degree to a few degrees above the vapour temperature resulting from the total pressure selected.

6. A process for extracting natural liquor from ligneous plant matter according to claim 1, characterised in that the volume of water at atmospheric pressure and external ambient temperature is equivalent to two to four times the volume of air contained in the enclosure in the same conditions.

7. A process for extracting natural liquor from ligneous plant matter according to claim 6, characterised in that the volume necessary for the saturated vapour pressure, for the operational temperature selected, is about three times the air mass contained in the enclosure at ambient temperature.

8. A process for extracting natural liquor from ligneous, plant matter according to claim 1, characterised in that the electromagnetic wave frequency is adapted to the size of the mass of plant matter to be processed in the enclosure, so as to allow the waves to penetrate right to the core of the plant mass to be processed.

9. A process for extracting natural liquor from ligneous plant matter according to claim 1, characterised in that the wave frequency is between 13 MHz and 2450 MHz.

10. A process for extracting natural liquor from ligneous plant matter according to claim 1, characterised in that it comprises a stage of draining off the liquors out of the enclosure under pressure during or in the course of the extraction process.

11. A process for extracting natural liquor from ligneous plant matter according to claim 9, characterised in that it comprises a stage of adaptation, after the liquors have been drained off, of the conditions of total pressure, temperature and microwave control power to facilitate the penetration into the wood of additive products injected into the enclosure.

12. A device allowing the process to be implemented, characterised in that it is constituted by a sealed enclosure resistant to pressure by a plurality of windows made of quartz or of any other wave suiting material with an electromagnetic wave generator placed near each window, so as to emit the waves transversely to the mass of plant material placed in the enclosure, a device for generating saturated water vapour at pressure above atmospheric pressure so as to create or inject a saturated water vapour pressure at a vapour temperature and at a total pressure determined as a function of the plant to be processed.

13. A device according to claim 12, characterised in that it comprises pressurised air circulation means.

14. A device according to claim 12, characterised in that the vapour generator device allows pressurised vapour to be injected at the pre-set vapour temperature and total pressure.

15. A device according to claim 14, characterised in that the vapour generator device comprises in the enclosure a receptacle for receiving a quantity of water corresponding to two to four times the air mass contained in the enclosure at external ambient temperature and means of heating this water to bring it to the vapour state.

16. A device according to claim 15, characterised in that the heating means are controlled by a device, which measures the total pressure prevailing within the enclosure allowing the water heating to be interrupted when the desired pressure is reached.

17. A device according to claim 12, characterised in that the enclosure comprises a device for recovering liquors by run-off and/or gravity of the liquors extracted from the matter.

18. A device according to claim 17, characterised in that the liquor recovery device communicates via a sluice with the outside of the enclosure, said sluice being controlled in order to carry out partial draining of liquor while the machine is operating.

19. A device according to claim 12, characterised in that the mass of plant matter processed in a liquor extraction operation is constituted by a plant oil type and the pressure and temperature conditions are determined as a function of the plant oil type in order to extract the worthwhile active constituents in the best conditions.

20. A device according to claim 19, characterised in that the plants are processed with bark or without bark straight from felling.

21. A device according to claim 19, characterised in that the plants are the branches and leaves resulting from pruning.

22. A natural liquor obtained by the process according to claim 1, characterised in that it is obtained from the processing of ligneous plant matter.

* * * * *